US007556514B1

(12) United States Patent
Sorensson et al.

(10) Patent No.: US 7,556,514 B1
(45) Date of Patent: Jul. 7, 2009

(54) ELECTRICAL POWER SUPPLY DEVICE, AND CONNECTOR

(75) Inventors: Stefan Sorensson, Sodra Sandby (SE); Henrik Heringslack, Malmo (SE); Fredrik Bagenholm, Malmo (SE); Per Holmberg, Dalby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/114,023

(22) Filed: May 2, 2008

Related U.S. Application Data

(60) Provisional application No. 61/023,294, filed on Jan. 24, 2008.

(51) Int. Cl.
*H01R 13/44* (2006.01)

(52) U.S. Cl. ..... 439/140; 200/51 R

(58) Field of Classification Search ..... 439/140, 439/141, 188; 200/51.01–51.17, 51 R
See application file for complete search history.

(56) References Cited

U.S. PATENT DOCUMENTS

| | | | | |
|---|---|---|---|---|
| 4,340,267 | A * | 7/1982 | Nukaga | 439/141 |
| 5,518,411 | A * | 5/1996 | Belleci | 439/141 |
| 6,062,881 | A * | 5/2000 | Ellison | 439/141 |
| 6,231,358 | B1 * | 5/2001 | Kerr et al. | 439/140 |
| 6,743,030 | B2 * | 6/2004 | Lin et al. | 439/131 |
| 6,770,986 | B2 * | 8/2004 | Nagao et al. | 307/326 |
| 7,121,851 | B1 * | 10/2006 | Beatty et al. | 439/131 |
| 7,153,148 | B2 * | 12/2006 | Chen et al. | 439/141 |
| 7,303,411 | B1 * | 12/2007 | Morganstern et al. | 439/131 |
| 7,416,419 | B2 * | 8/2008 | Collantes et al. | 439/76.1 |
| 7,416,423 | B2 * | 8/2008 | Chi et al. | 439/131 |
| D581,413 | S * | 11/2008 | Kim | D14/356 |
| 2002/0123256 | A1 * | 9/2002 | Brickett | 439/140 |
| 2006/0052001 | A1 * | 3/2006 | Parker | 439/358 |
| 2006/0240692 | A1 * | 10/2006 | Regen et al. | 439/131 |
| 2008/0050952 | A1 * | 2/2008 | Regen et al. | 439/131 |
| 2008/0280490 | A1 * | 11/2008 | Nguyen et al. | 439/607 |
| 2008/0305662 | A1 * | 12/2008 | Regen et al. | 439/131 |

* cited by examiner

*Primary Examiner*—Michael C Zarroli
*Assistant Examiner*—Harshad C Patel
(74) *Attorney, Agent, or Firm*—Renner, Otto, Boisselle & Sklar, LLP

(57) ABSTRACT

A connector for an electric power supply device is disclosed. The connector is arranged to mate a corresponding connector at an apparatus to which the electrical power supply device is arranged to supply electrical power, wherein the connector comprises at least one electrical contact; a housing having a first part arranged grippable by a user when the user connects or disconnects the connector to the device, and a second part slidably arranged with the first part; at least one electrical contact arranged on one of said first or second part, wherein a first force for connecting the at least one electrical contact to the corresponding mating connector is higher than a second force for causing sliding between said first and second parts; and a switch arranged to be actuated based upon relative positions of said first and second parts, wherein said switch is arranged to electrically control connection and disconnection of an electrical power input of the electric power supply device. A power supply device is also disclosed.

28 Claims, 5 Drawing Sheets

ELECTRICAL POWER SUPPLY DEVICE, AND CONNECTOR

TECHNICAL FIELD

The present invention relates to an electrical power supply device for apparatuses, and a connector. In particular, the invention relates to user intuitive control of input of supply power to the power supply device.

BACKGROUND

Electrical power supply devices for apparatuses are in common use. It can be chargers for mobile telephones, personal digital assistants, laptop computers etc., or direct current (DC) power supply devices for electronics such as wireless local access network nodes, computer accessories, consumer electronics, etc. The power supply devices are normally arranged to provide a DC output. The power supply devices can be connected to alternating current mains for down-conversion and rectifying of voltage, or be connected to a DC output, for example in a car, for down-conversion or up-conversion of the voltage to a desired level. A problem that arises from these supply devices is that energy is consumed, although at a low power level, when the supply device is left plugged into the input supply, but as the supply devices often are left there for long time, a non-negligible amount of energy is consumed. For example, a mobile phone charger is permanently connected to mains, and used for charging a mobile phone during a few hours a week, but will consume stand-by power the remaining time. It is therefore a problem how to reduce energy consumption in an electrical power supply device.

SUMMARY

The present invention is based on the understanding that user intuitive interaction with the power supply device will improve energy consumption in practice. The invention is further based on the understanding that user interaction in connection with the power supply device is mostly in relation to connecting or disconnecting the power supply device to the apparatus in question which it is intended to supply power to.

According to a first aspect of the present invention, there is provided a connector for an electric power supply device, arranged to mate a corresponding connector at an apparatus to which the electrical power supply device is arranged to supply electrical power, wherein the connector comprises at least one electrical contact; a housing having a first part arranged grippable by a user when the user connects or disconnects the connector to the device, and a second part slidably arranged with the first part; at least one electrical contact arranged on one of said first or second part, wherein a first force for connecting the at least one electrical contact to the corresponding mating connector is higher than a second force for causing sliding between said first and second parts; and a switch arranged to be actuated based upon relative positions of said first and second parts, wherein said switch is arranged to electrically control connection and disconnection of an electrical power input of the electric power supply device.

The at least one electrical contact may be arranged on said second part, or on said first part. The second part may be kept by a spring force in a position relative to the first part when the connector is disconnected from the apparatus where the switch electrically controls disconnection of the electrical power input of the electric power supply. The spring force may be applied by a spring arranged between the first part and the second part.

The first part may be arranged to slide in a direction towards the apparatus relative to the second part upon connection, and in a direction from the apparatus relative to the second part upon disconnection. Alternatively, the second part may be arranged to slide in a direction towards the apparatus relative to the first part upon connection, and in a direction from the apparatus relative to the second part upon disconnection.

The second part may essentially encircle said first part. Alternatively, the first part may essentially encircle said second part.

The second part may essentially comprise of the at least one electrical contact.

The switch may comprise mating contactors arranged on said first and second parts.

The switch may be constructively configured to operate based on any of capacitive, magnetic, or optical effects, or a combination thereof.

The connector may further comprise a visual indicator arranged to indicate a sliding state of said connector.

According to a second aspect of the present invention, there is provided an electrical power supply device comprising an electrical power input and an electrical power output, wherein the electrical power output comprises a connector arranged to mate a corresponding connector at an apparatus to which the electrical power supply device is arranged to supply electrical power, wherein the connector comprises at least one electrical contact; a housing having a first part arranged grippable by a user when the user connects or disconnects the connector to the device, and a second part slidably arranged with the first part, wherein said at least one electrical contact is arranged on one of said first part or said second part, wherein a first force for connecting the at least one electrical contact to the corresponding mating connector is higher than a second force for causing sliding between said first and second parts; and a switch arranged to be actuated upon relative positions of said first and second parts, wherein said switch electrically controls connection and disconnection of said electrical power input.

The connector may have features according to the first aspect of the invention. The switch may control said connection and disconnection of said electrical power input by the electrical power input being electrically connected via said switch.

The switch may control said connection and disconnection of said electrical power input by a control signal provided by said switch, wherein the control signal is arranged to control a current valve of the electrical power input. The current valve may be a relay, a controlled switch element, or other controllable element for controlled provision of voltage and/or current.

The electrical power supply device may further comprise an electrical power storage and a controller, wherein the controller is arranged to provide the control signal based on said switch, and to be supplied by said electrical power storage when said electrical power input is disconnected.

The controller may further be arranged to adapt said control signal to re-charge said electrical power storage when energy level of said electrical power storage is lower than a threshold where electrical power supply to said controller cannot be guaranteed.

DETAILED DESCRIPTION OF PREFERRED EMBODIMENTS

In this context, the term "connector" is used for the assembly forming the functional element for both mechanical and electrical connection, while the term "contact" (noun) is used for the functional element providing the specific electrical connection, such as a pin, pad, ball, finger comprising electrically conductive material.

Figure 1A:
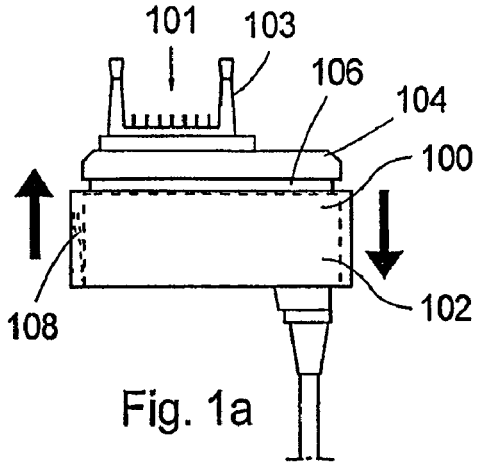
FIGS. 1*a* and 1*b* illustrate a connector for an electrical power supply device according to an embodiment of the present invention.
Figure 1B:
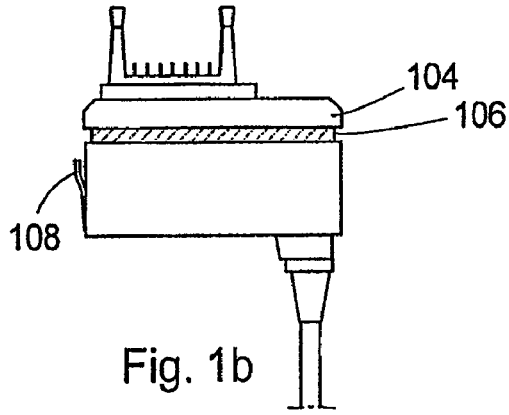

FIG. 1*a* illustrates a connector 100 of an electrical power supply according to an embodiment of the present invention. The connector comprises electrical contacts 101 for providing electrical contact to a mating contact (not shown). FIG. 1*a* shows the connector with a first part 102 arranged such that a user is able to grip this part 102 when connecting and disconnecting the connector such that the first part 102 slides in relation to a second part 104 due to the force applied for inserting and taking out the connector from a device which the power supply is supposed to mate to for supplying power, which is defined by guiding elements 103. FIG. 1*b* shows the second part 104, i.e. the first part 102 is removed. A visual indicator 106 can be provided to indicate to the user that the power supply device is in an off-state, as will be further discussed with reference to FIGS. 7 and 8. The first and second parts 102, 104 are arranged to actuate a switch 108 upon moving from their relative sliding states. The principle is that the force for connecting and disconnecting is larger than the force needed to slide the first and second parts 102, 104 in relation to each other. Thus, the state change will be performed automatically when the user connects and disconnects the connector 100.

Figure 1C:
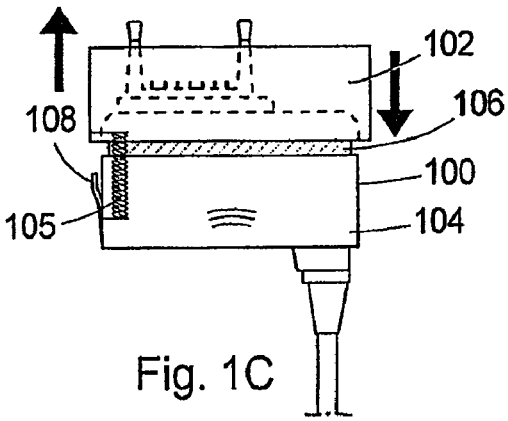
FIG. 1*c* illustrates an alternative embodiment of a connector.

FIG. 1*c* illustrates an alternative embodiment where the first part 102 is arranged to slide out and cover the electrical contacts 101 when disconnected, and upon connection, the first part 102 will slide back over the second part 104. Thus, the user grips the second part for connecting and disconnecting in this embodiment. To make the first part slide out on disconnection, there is preferably applied a spring force in a position relative to the first part when the connector is disconnected from the apparatus such that the switch electrically controls disconnection of the electrical power input of the electric power supply. The spring force is for example applied by a spring 105 arranged between the first part 102 and the second part 104. Besides this, the features are similar to the embodiment illustrated in FIG. 1*a*.

Figure 2A:
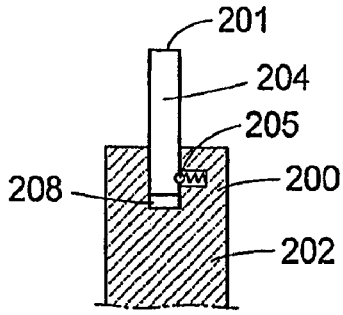
FIGS. 2*a* and 2*b* illustrate a connector of an electrical power supply according to an embodiment of the present invention.
Figure 2B:
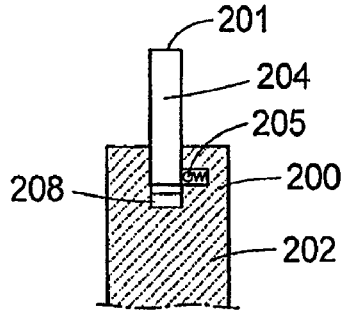

FIGS. 2*a* and 2*b* illustrate a connector 200 of an electrical power supply according to an embodiment of the present invention. The connector 200 is arranged such that a second part 204 can consist of an electrical contact 201 only, or possibly accompanied by mechanical element forming the element that is arranged to slide with relation to a first part 202. In FIG. 2*a*, the connector is in its connected state, and a switch 208, arranged in the first part 202, is actuated. The first and second parts 202, 204 are kept in position by a spring operated positioning element 205, e.g. a ball or pin. The keeping force provided by the positioning element 205 is less than the force needed for disconnecting the connector 200. Thus, when disconnecting the connector 200, the second part 204 will slide out of the first part 202, as illustrated in FIG. 2*b* and the switch 208 will no longer be operated. At connection of the connector, the procedure will be reversed, and the second part 204 will slide into the first part 202 and engage the switch 208.

In FIGS. 1*a*-2*b*, the elements of connecting the electrical contacts 101, 201 to the power supply are not illustrated not to obscure the core principle of the invention, and these elements are conventionally designed.

Figure 3:
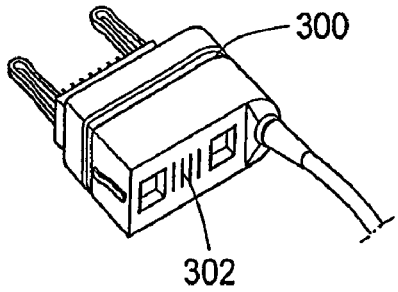
FIG. 3 illustrates a connector of an electrical power supply according to an embodiment of the present invention.

FIG. 3 illustrates a connector 300 of an electrical power supply device according to an embodiment of the present invention, where a second set of electrical contacts 302 is provided to enable cascading of connectors. Note that only the second part is illustrated, cf. the connector 100 of FIG. 1, and the first part is removed. Besides this, the connector 300 has similar features as demonstrated for the connector 100 with reference to FIG. 1.

Figure 4A:
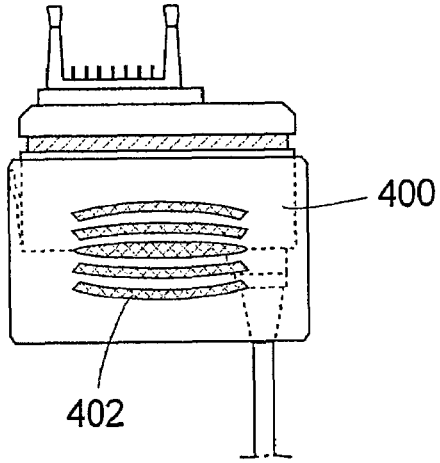
FIGS. 4*a*-4*c* illustrate a connector of an electrical power supply according to an embodiment of the present invention.
Figure 4B:
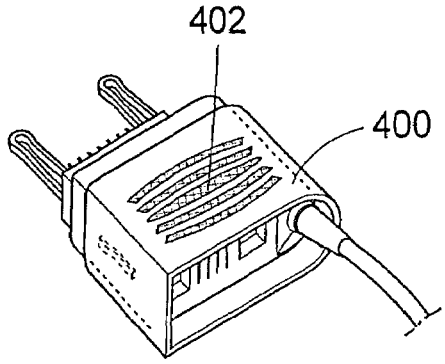
Figure 4C:
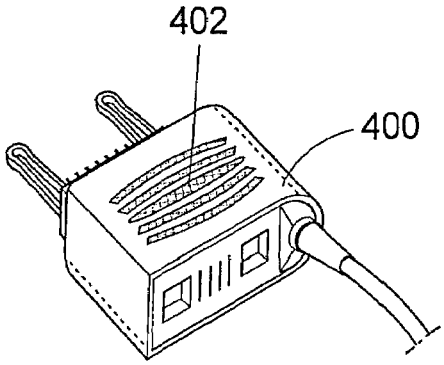

FIGS. 4*a*-4*c* illustrate a connector 400 of an electrical power supply according to an embodiment of the present invention. The connector 400 has similar features as demonstrated for the connector 300 with reference to FIG. 3, and also a surface 402 for enhancing grip performance for a user when connecting and disconnecting the connector 400.

Figure 5A:
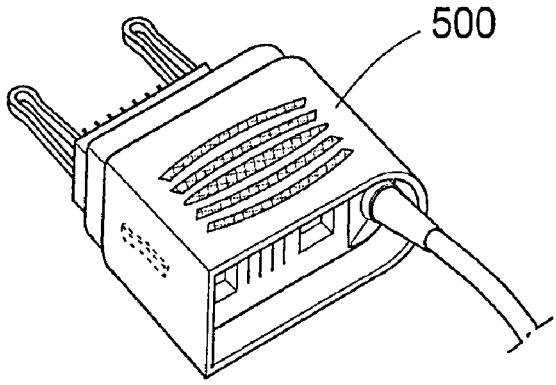
FIGS. 5*a* and 5*b* illustrate use of a connector of an electrical power supply according to an embodiment of the present invention.
Figure 5B:
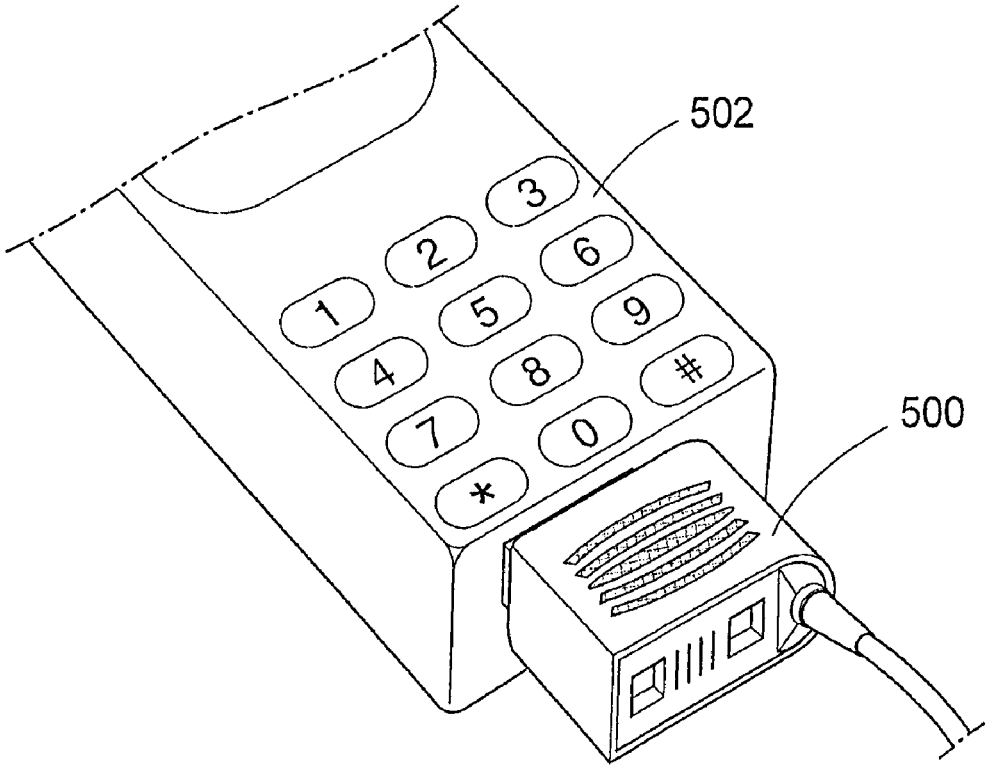

FIGS. 5*a* and 5*b* illustrate use of a connector 500 of an electrical power supply according to an embodiment of the present invention. In FIG. 5*a*, the connector 500 is illustrated in its disconnected state, and in FIG. 5*b*, the connector 500 is connected to a device 502 to which it supplies power from the electrical power supply (not shown). The connector 500 can have features according to what has been demonstrated for any of the connectors disclosed with reference to FIGS. 1-4, although the illustration show the connector discussed with reference to FIG. 4 for illustrative purposes.

Figure 6B:
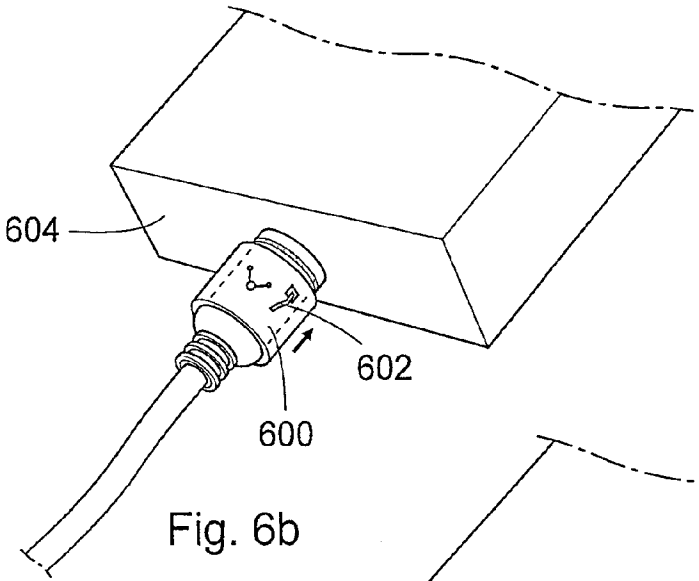
FIGS. 6*a*-6*c* illustrate principle and use of a connector of an electrical power supply according to an embodiment of the present invention.
Figure 6C:
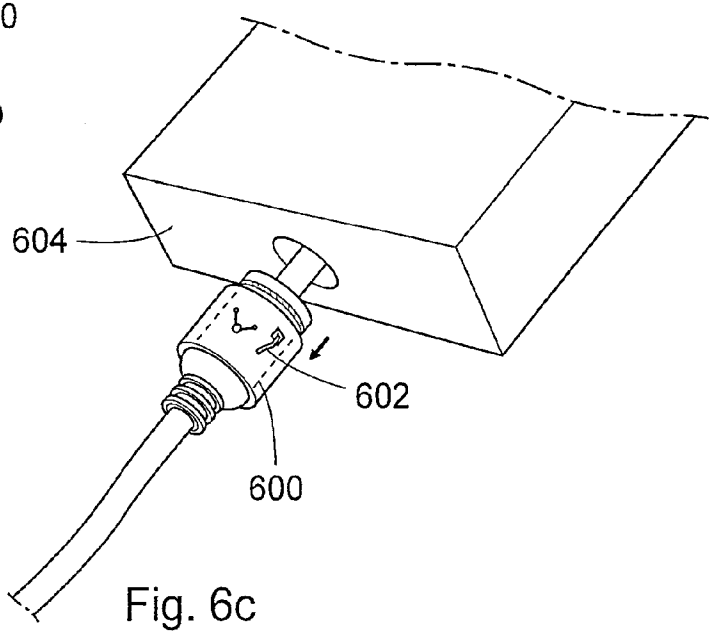
Figure 6A:
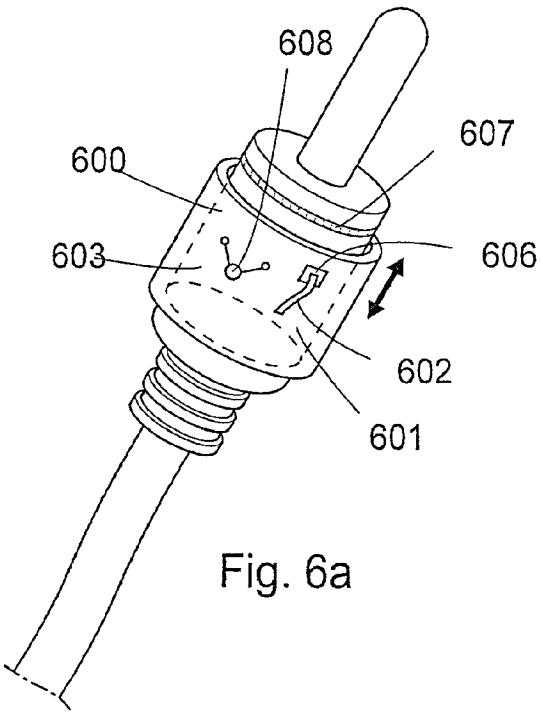

FIGS. 6*a* and 6*b* illustrate principle and use of a connector 600 of an electrical power supply according to an embodiment of the present invention. The connector 600 has a first part 601 and a second part 603 being slidably arranged according to the principle of the present invention, and arranged to activate and de-activate a switch 602. The switch can comprise mating contactors 606, 607 arranged on the first and second parts 601, 603, respectively, such that the contactors 606, 607 are brought into mutual contact in one of the sliding states. A bi-stable spring 608 can be arranged to keep the relative position of the first and second parts 101, 103 well defined in the sliding states, respectively. FIG. 6*b* illustrates the connector 600 being connected to a device 604, and FIG. 6*b* illustrates disconnection.

Figure 7:
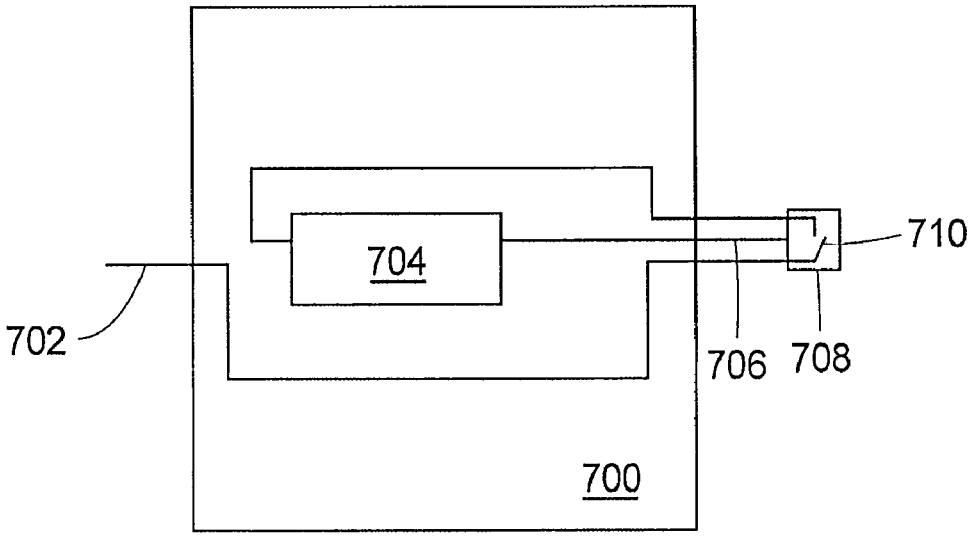
FIG. 7 schematically illustrates an electrical power supply according to an embodiment of the present invention.

FIG. 7 schematically illustrates an electrical power supply 700 according to an embodiment of the present invention. The electrical power supply comprises an electrical power input 702, a current and/or voltage converting element 704, and an electrical power output 706 connected to a connector 708. The connector 708 comprises an arrangement according to any of the connectors discussed with reference to FIGS. 1-6 and thus comprises a switch 710 which is actuated based on the sliding state of the connector 708. The electrical power input 702 is electrically connected via the switch 710 such that the electrical power input 702 is connected/disconnected to the current and/or voltage converting element 704 as the connector 708 is connected/disconnected. Thus, no stand-by energy consumption is present when the electrical power supply is not in use, although it may be connected to e.g. AC mains or a DC source.

Figure 8:
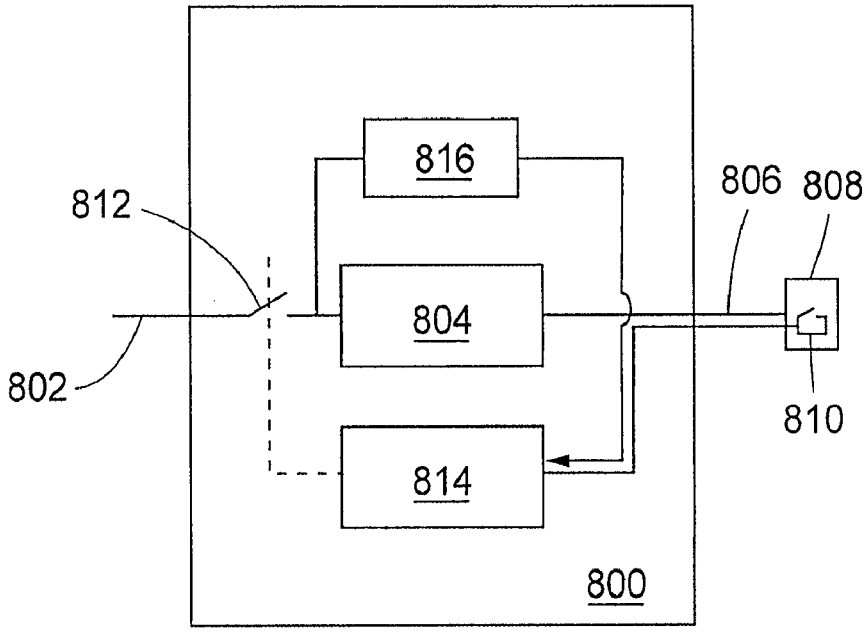
FIG. 8 schematically illustrates an electrical power supply according to an embodiment of the present invention.

FIG. 8 schematically illustrates an electrical power supply 800 according to an embodiment of the present invention. The electrical power supply comprises an electrical power input 802, a current and/or voltage converting element 804, and an electrical power output 806 connected to a connector 808. The connector 808 comprises an arrangement according to any of the connectors discussed with reference to FIGS. 1-6 and thus comprises a switch 810 which is actuated based on the sliding state of the connector 808. The electrical power input 802 is electrically connected via a current valve 812, e.g. a relay or controlled switch element, controlled by a controller 814 based on a signal provided by the switch 810 such that the electrical power input 802 is connected/disconnected to the current and/or voltage converting element 804 as the connector 808 is connected/disconnected. Thus, no stand-by energy consumption is present when the electrical power supply is not in use, although it may be connected to e.g. AC mains or a DC source. The electrical power supply can also comprise an electrical power storage 816, wherein the controller 814 is supplied by said electrical power storage 816 when the electrical power input 802 is disconnected. The controller 814 can further be arranged to adapt the control signal to re-charge the electrical power storage 816 when energy level of the electrical power storage 816 is lower than a threshold where supply to the controller 814 cannot be guaranteed. The electrical power storage 816 can comprise a battery, or preferably comprise a capacitor for storing the electrical energy. So called supercaps are especially suited for this.

The switches 108, 208, 602, 710, 810 have in the examples given above been described as mechanical switches actuated by the sliding between the parts of the connector. However, the switch can be replaced by a switch relying on capacitive, magnetic, or optical effects, which is arranged to provide the control of connection and disconnection of the electrical power input to the electrical power supply device.

What we claim is:

1. A connector for an electric power supply device, arranged to mate a corresponding connector at an apparatus to which the electrical power supply device is arranged to supply electrical power, wherein the connector comprises at least one electrical contact;

a housing having a first part arranged grippable by a user when the user connects or disconnects the connector to the device, and a second part slidably arranged with the first part;

said at least one electrical contact arranged on one of said first and second part, wherein a first force for connecting the at least one electrical contact to the corresponding mating connector is greater than a second force for causing sliding between said first and second parts; and a switch arranged to be actuated based upon relative positions of said first and second parts, wherein said switch is arranged to electrically control connection and disconnection of an electrical power input of the electric power supply device.

2. The connector according to claim 1, wherein said at least one electrical contact is arranged on said second part.

3. The connector according to claim 1, wherein said at least one electrical contact is arranged on said first part.

4. The connector according to claim 3, wherein the second part is kept by a spring force in a position relative to the first part when the connector is disconnected from the apparatus where the switch electrically controls disconnection of the electrical power input of the electric power supply.

5. The connector according to claim 4, wherein the spring force is applied by a spring arranged between the first part and the second part.

6. The connector according to claim 1, wherein the first part is arranged to slide in a direction towards the apparatus relative to the second part upon connection, and in a direction from the apparatus relative to the second part upon disconnection.

7. The connector according to claim 1, wherein the second part is arranged to slide in a direction towards the apparatus relative to the first part upon connection, and in a direction from the apparatus relative to the second part upon disconnection.

8. The connector according to claim 1, wherein the second part essentially encircle said first part.

9. The connector according to claim 1, wherein the first part essentially encircle said second part.

10. The connector according to claim 1, wherein the second part essentially comprise of the at least one electrical contact.

11. The connector according to claim 1, wherein the switch comprises mating contactors arranged on said first and second parts.

12. The connector according to claim 1, wherein the switch is constructively configured to operate based on any of capacitive, magnetic, or optical effects, or a combination thereof.

13. The connector according to claim 1, further comprising a visual indicator arranged to indicate a sliding state of said connector.

14. The device according to claim 1, wherein the second part essentially comprises of the at least one electrical contact.

15. The device according to claim 1, wherein the switch comprises mating contactors arranged on said first and second parts.

16. An electrical power supply device comprising an electrical power input and an electrical power output, wherein the electrical power output comprises a connector arranged to mate a corresponding connector at an apparatus to which the electrical power supply device is arranged to supply electrical power, wherein the connector comprises at least one electrical contact;

a housing having a first part arranged grippable by a user when the user connects or disconnects the connector to the device, and a second part slidably arranged with the first part, wherein said at least one electrical contact is arranged on one of said first part and said second part, wherein a first force for connecting the at least one electrical contact to the corresponding mating connector is greater than a second force for causing sliding between said first and second parts; and a switch arranged to be actuated upon relative positions of said first and second parts, wherein said switch electrically controls connection and disconnection of said electrical power input.

17. The device according to claim 16, wherein said at least one electrical contact is arranged on said second part.

18. The device according to claim 16, wherein said at least one electrical contact is arranged on said first part.

19. The device according to claim 18, wherein the second part is kept by a spring force in a position relative to the first part when the connector is disconnected to the apparatus where the switch electrically controls disconnection of the electrical power input of the electric power supply.

20. The device according to claim 19, wherein the spring force is applied by a spring arranged between the first part and the second part.

21. The device according to claim 16, wherein said switch controls said connection and disconnection of said electrical power input by the electrical power input being electrically connected via said switch.

22. The device according to claim 16, wherein said switch controls said connection and disconnection of said electrical power input by a control signal provided by said switch, wherein the control signal is arranged to control a current valve of the electrical power input.

23. The device according to claim 22, further comprising an electrical power storage and a controller, wherein the controller is arranged to provide the control signal based on said switch, and to be supplied by said electrical power storage when said electrical power input is disconnected.

24. The device according to claim 23, wherein the controller further is arranged to adapt said control signal to re-charge said electrical power storage when energy level of said electrical power storage is lower than a threshold where electrical power supply to said controller cannot be guaranteed.

25. The device according to claim 16, wherein the first part is arranged to slide in a direction towards the apparatus relative to the second part upon connection, and in a direction from the apparatus relative to the second part upon disconnection.

26. The device according to claim 16, wherein the first part essentially encircle said second part.

27. The device according to claim 16, wherein the switch is constructively configured to operate based on any of capacitive, magnetic, or optical effects, or a combination thereof.

28. The device according to claim 16, further comprising a visual indicator arranged to indicate a sliding state of said connector.

* * * * *